US005364145A

United States Patent [19]

Epstein

[11] Patent Number: 5,364,145

[45] Date of Patent: Nov. 15, 1994

[54] SINGLE ACTION ROTARY RELEASE HOOK

[76] Inventor: Irving Epstein, 4216 Shore Club Dr., Mercer Island, Wash. 98115

[21] Appl. No.: 63,728

[22] Filed: May 20, 1993

[51] Int. Cl.[5] ..... B66C 1/38

[52] U.S. Cl. ..... 294/82.27; 294/82.33; 114/252

[58] Field of Search ..... 294/82.27, 82.31, 82.33, 294/82.34; 114/217, 230, 252, 253

[56] References Cited

U.S. PATENT DOCUMENTS

| | | | |
|---|---|---|---|
| 110,116 | 12/1870 | Cottingham | 294/82.27 |
| 4,249,765 | 2/1981 | Janssen . | |
| 4,281,867 | 8/1981 | Kariagin | 294/82.27 X |
| 4,389,907 | 6/1983 | Epstein | 114/252 X |
| 4,471,511 | 9/1984 | Phipps | 294/82.27 X |
| 4,658,748 | 4/1987 | Epstein | 294/82.27 X |
| 4,827,861 | 5/1989 | Goode | 114/242 X |
| 5,123,374 | 6/1992 | McMillan | 114/230 |
| 5,205,600 | 4/1993 | Moore | 294/82.33 X |

FOREIGN PATENT DOCUMENTS

| | | |
|---|---|---|
| 275429 | 2/1966 | Australia . |
| 1114586 | 12/1931 | Canada . |
| 843162 | 6/1970 | Canada . |
| 1064074 | 10/1979 | Canada . |
| 2847558 | 11/1978 | Germany . |
| 868847 | 5/1961 | United Kingdom . |
| 1556070 | 11/1979 | United Kingdom . |

*Primary Examiner*—Dean J. Kramer
*Attorney, Agent, or Firm*—Tom Secrest

[57] ABSTRACT

This invention is directed to rotary release hook apparatus comprising a rotatable release hook of a generally circular configuration. In the release hook there is a recess for receiving a cable or a rope or a chain. The rotary release hook apparatus can be on a dock or an oil well platform or a barge or another suitable device. The cable or rope or chain cam connect with a boat or a ship or a barge or other large similar object. In the release hook there is a notch. There is a rotatable pawl having a projecting finger projecting into the notch to prevent rotation of the release hook. There is a rotatable member having a recess. Part of the pawl bears against the rotatable member. There is a release lever arm connecting with the rotatable means for rotating the rotatable member to allow the pawl to move into the recess and away from the rotatable release hook. This allows the rotatable release hook to rotate to release the cable or rope or chain. Further, there is a locking member to restrict the movement of the release lever arm and thereby to restrict the rotation of the rotatable members and thereby to restrict the rotation of the rotatable pawl and thereby to restrict the rotation of the rotatable release hook.

4 Claims, 2 Drawing Sheets

SINGLE ACTION ROTARY RELEASE HOOK

THE BACKGROUND OF THE INVENTION

Ships and boats are tied to a dock by a line. The ships and boats must be securely tied to the dock until it is time to be released from the dock. Then, the line can be released from the ship or from the dock and the ship and boat allowed to move away from the dock.

Normally, the line is attached to the ship or boat and runs to the dock. On the dock there is a releasable hook. The releasable hook is of such construction as to be able to withstand the pulling on the line by the boat. Due to the action of the water, the boat is moved with respect to the dock and the line running from the boat or ship to the dock must be sufficiently strong so as not to break with this movement of the boat or ship and also the releasable hook must be of such construction as to not break or release the line upon the pulling of the line by the ship or boat.

The releasable hook on the dock has two main functions. One of these functions is to firmly position the line running from the ship or boat so that the line will not move away from the releasable hook and therefore the ship or boat will not move away from the releasable hook and the dock. A second function of the releasable hook is to, positively, release the line when the releasable hook is tripped so that the ship or boat can move away from the dock.

THE GENERAL DESCRIPTION OF THE INVENTION

Release hooks have been in use for a number of years. The most common type of release hook has been the one comprising a hook which can rotate, approximately, 90 to 120 degrees. The hook is released and the line connecting with the boat or ship causes the hook to rotate. The hook rotates rapidly and hits a bumper plate or a solid plate and then bounces. Again, the hook rotates approximately 90 degrees to 120 degrees.

The rotary release hook of this invention comprises a rotary hook which is free to rotate indefinitely 360 degrees.

There is a line connecting with the hook and also with a ship or boat. With the release of the locking mechanism on the hook, the line will pull on the hook so as to be released from the hook. The line upon pulling upon the hook causes the hook to rotate. Again, the hook is free to rotate 360 degrees for approximately 7 to 12 seconds. Generally, the indefinite period of time is the time that is required to dissipate the energy imparted to the hook by the line moving away from the hook and causing the hook to rotate.

The subject single action rotary release hook differs from the generally used prior release hooks in that the rotary release hook does not strike a bumper plate or does not strike another object. The rotary release hook continues to rotate for about 7 to 12 seconds until the energy is dissipated and then the hook stops rotating.

To repeat, contrasted with the prior release hooks, the prior release hooks would hit a bumper plate or bumper and bounce vertically and even move horizontally. The subject rotary release hook rotates until the energy is dissipated. This is a safety feature as the rotary release hook of this invention does not bounce and therefor there is less possibility of injury and damage to the operator of the hook.

The rotary release hook comprises a rotatable locking pawl to prevent rotation of the hook. Further, there is a rotatable locking pin to prevent rotation of the rotatable locking pawl. Also, there is a lever mechanism to prevent accidental rotation of the locking pin and the locking pawl. As a result the hook cannot be released accidentally.

THE OBJECTS AND THE ADVANTAGES

One of the objects and advantages of this invention is a safety feature. Upon the release of a line from a release hook a large amount of energy is imparted to the release hook. This energy must be dissipated. With this rotary release hook the energy is dissipated by the rotary release hook continuing to rotate indefinitely until the energy is dissipated. The release hook rotates about 7 to 12 seconds to dissipate the energy.

Another advantage of this invention is that it is possible for an operator to manually turn the locking pin from either side of the rotary release hook.

A further important object and advantage is a rotating cam which upon rotating rotates a locking pawl away from the rotary hook to allow the rotary hook to rotate. Further, the cam locks the pawl in a position so that the pawl cannot bounce and contact the rotating rotary hook.

A further object and advantage is to have a positive locking mechanism to prevent the rotary release hook from releasing the line until the desired time.

An important object is to have a lever mechanism to prevent accidental rotation of the locking pin and the locking pawl.

A still further important object of this invention is to have a central locking and release mechanism for the rotary release hook.

Finally, another important object and advantage is to have an easily operated rotary release hook.

APPLICANT'S PRIOR PATENTS

| NUMBER | DATE | TITLE |
|---|---|---|
| 4,658,748 | 21 Apr 1987 | Releaseable Hook |
| 4,611,842 | 16 Sep 1986 | Releaseable Hook |
| 3,761,122 | 25 Sep 1973 | Releasable Hook |
| 3,762,757 | 02 Oct 1973 | Releasable Hook |
| 3,827,513 | 06 Aug 1974 | Apparatus For Measuring Powder |
| 3,811,720 | 21 May 1974 | Releasable Hook |
| 4,572,565 | 25 Feb 1986 | Stopper For A Wire Rope |
| 3,407,778 | 29 Oct 1968 | Marine Towing Plate |
| 3,498,340 | 03 Mar 1970 | Method And An Apparatus For Positioning A Wire Rope In A Socket |
| 4,389,907 | 28 Jun 1983 | Releasable Hook |
| 4,034,992 | 12 Jul 1977 | Releasable Hook |
| 5,190,435 | 2 March 1993 | Fork Lift Truck |

There is a copending patent application Ser. No. 07/989,701; filing date Dec. 14, 1992, entitled "Single Action Rotary Release Hook".

FOREIGN PATENTS

| | | |
|---|---|---|
| | | Canada |
| 1,114,586 | 22 Dec 1981 | Releaseable Hook |
| 843,162 | 02 Jun 1970 | Marine Towing Plate |
| 1,064,074 | 09 Oct 1979 | Releasable Hook |
| | | Great Britain |
| 1,556,070 | 21 Nov 1979 | Releasable Hook Assembly |

None of the above stated patents are for a rotary release hook. Many of these patents are for a rotatable release hook which may rotate through about 120 degrees but not rotate through 360 degrees indefinitely. The above identified release hooks rotate through an angle less than 360 degrees as compared with a rotary release hook which rotates through 360 degrees indefinitely until the energy is released.

PRIOR ART

A patent search was not made in the preparation of this patent application.

Four patents which have come to the attention of the inventor are: Hans-Georg Janssen-U.S. Pat. No. 4,249,765 - Feb. 10, 1981 James Clyde Dingle-Australian Patent 275,429-Feb. 3, 1966 Johann Knief-German Patent 28 47 558 -Nov. 8, 1979 -Great Britain 868,847-

U.S. Pat. No. 4,249,765 of Hans-Georg Janssen teaches of a rotary release hook 6 having two arms in which we find an "S" shaped hook. On each of the arms there is an abutment 8. There is a locking member 9 which, when pressed against the abutment 8, locks the hook member 6 to prevent rotation. The locking member 9 is rotatable. There is a hydraulic cylinder in ram 10 connecting with the locking member 9. With the ram extended the locking member 9 bears against the abutment 8 to prevent rotation of the hook member 6. A rope or cable can be placed in the recess 7 of the hook member 6. This will tie and secure a barge or a boat or the like to a dock or an off-shore drilling platform or to another barge with the tow rope or cable in the recess 7 and attached to the other ship or barge or off-shore drilling platform or a dock. The hydraulic cylinder can be actuated to rotate the locking member 9 away from the abutment 8. This allows the hook member 6 to rotate and to release the rope or cable. The subject-invention differs from U.S. Pat. No. 4,249,765 in that the locking mechanisms are different and also the subject invention does not require the use of a hydraulic cylinder and ram.

The German patent number 28 47 558 of Johann Knief teaches of a rotary release hook. The tow rope easy-release arrangement for tugs applies to towing gear with the rotatable disc hook, held by a catch lever (38) engaging a notch in the disc rim. The lever free end bears against a D-section stop bar. Turning this releases the catch and allows the load to pull the tow rope free. That lever end now bears against a stop (56) on a pivoted (62) intermediate lever (58) whose other end (64) bears against the rotatable stop bar (66). Actuation is via an arm (70) and pin-jointed link (72), by pulling a catch (76) and release (74) lever with the same fulcrum (62) as the intermediate lever. The subject release hook differs from this German patent in that there is a rotary hook having edges at right angles for receiving the end of a pawl. The pawl prevents the subject rotary hook from rotating. By moving a lever the pawl is allowed to rotate. A tow rope in the subject rotary hook pulls on the hook and with the pawl free to rotate the subject hook can rotate. Again, the subject hook differs from the German Patent in that the pawl prevents rotation of the hook while in the German patent there is a lever mechanism to prevent rotation. The pawl and the lever mechanism are different. Further, in the subject release hook there is a lever mechanism to prevent accidental rotation of the locking pin and the locking pawl. The German patent does not have this lever mechanism.

The Australian patent number 275,429 of James Clyde Dingle teaches of a rotary disk 10 having a "V" cut of 11 for receiving a tow rope or a cable attached to a ship or a barge or a pier. The rotary disk 10 has a locking notch 15. There is a projection 16 which fits into the locking notch 15 to prevent rotation of the disk 10. Again, there is a tow rope or cable in the "V" cutout 11 which pulls on the disk 10. As long as the projection 16 is in the locking notch 15 of the disk 10 the disk 10 will not rotate even though there is a pulling on the cable or tow rope in the "V" cutout 11. With the removal of the projection 16 from the locking notch 15 the disk 10 rotates to release the tow rope or the cable. The subject invention differs from the Australian patent as there is a rotatable pawl having outward projection for fitting with two edges at right angles to each other in the rotary hook. The pawl prevents the rotation of the rotary hook as long as the projection is bearing against the edges in the hook. With the pawl free to move the tow rope or tow cable pulls on the rotary hook causing it to rotate and thereby releasing the tow rope or the cable. Further, in the subject release hook there is a lever mechanism to prevent accidental rotation of the locking pin and the locking pawl. The Australian patent does not have this lever mechanism.

Great Britain patent number 868,847 teaches of a rotary hook 3 having a recess for receiving a tow rope 7 or a cable 7. The rotary hook 3 has a notch 25 for receiving a rotatable projection 24. There is a restriction 27 or a restriction 33 to prevent rotation of the rotatable projection 24. With the rotatable projection 24 in the notch 25 the rotary hook 3 is prevented from rotating even though the tow rope or the cable 7 is pulling on the rotary hook 3. With the restriction 27 or the restriction 33 removed then the rotatable projection 24 can rotate. The pulling on the tow rope 7 or the cable 7 causes the rotary hook 3 to rotate to release the cable 7 or the tow rope 7. The subject invention differs from the Great Britain patent as there are two edges at right angles and a projecting member profiting with the recess defined by these two edges. The projecting member is prevented from rotating. With the projecting member free to rotate the rotary hook can rotate causing the projecting member to rotate away from the rotary hook to allow the tow rope or cable to be released from the rotary hook 12. This is different from the Great Britain patent because of the rotary pawl of the subject invention and the projecting member of the subject invention. Further, in the subject release hook there is a lever mechanism to prevent accidental rotation of the locking pin and the locking pawl. The British patent application does not have this lever mechanism.

A copy of these four patents accompanies this patent application.

THE DRAWINGS

In the drawings it is seen that:

FIGS. 1–5 are directed to a rotary release hook wherein FIG. 1 is a fragmentary axonometric view with part of the side of the frame broken away to illustrate the moveable locking members locking the rotatable release hook in a locked position;

FIG. 2, a fragmentary side elevational view, with part of the side of the frame broken away, and illustrates a rotor locking a pawl in position and which pawl in turn locks the rotary hook in position so that the rotary hook cannot rotate;

THE SPECIFIC DESCRIPTION OF THE INVENTION

Figure 1:
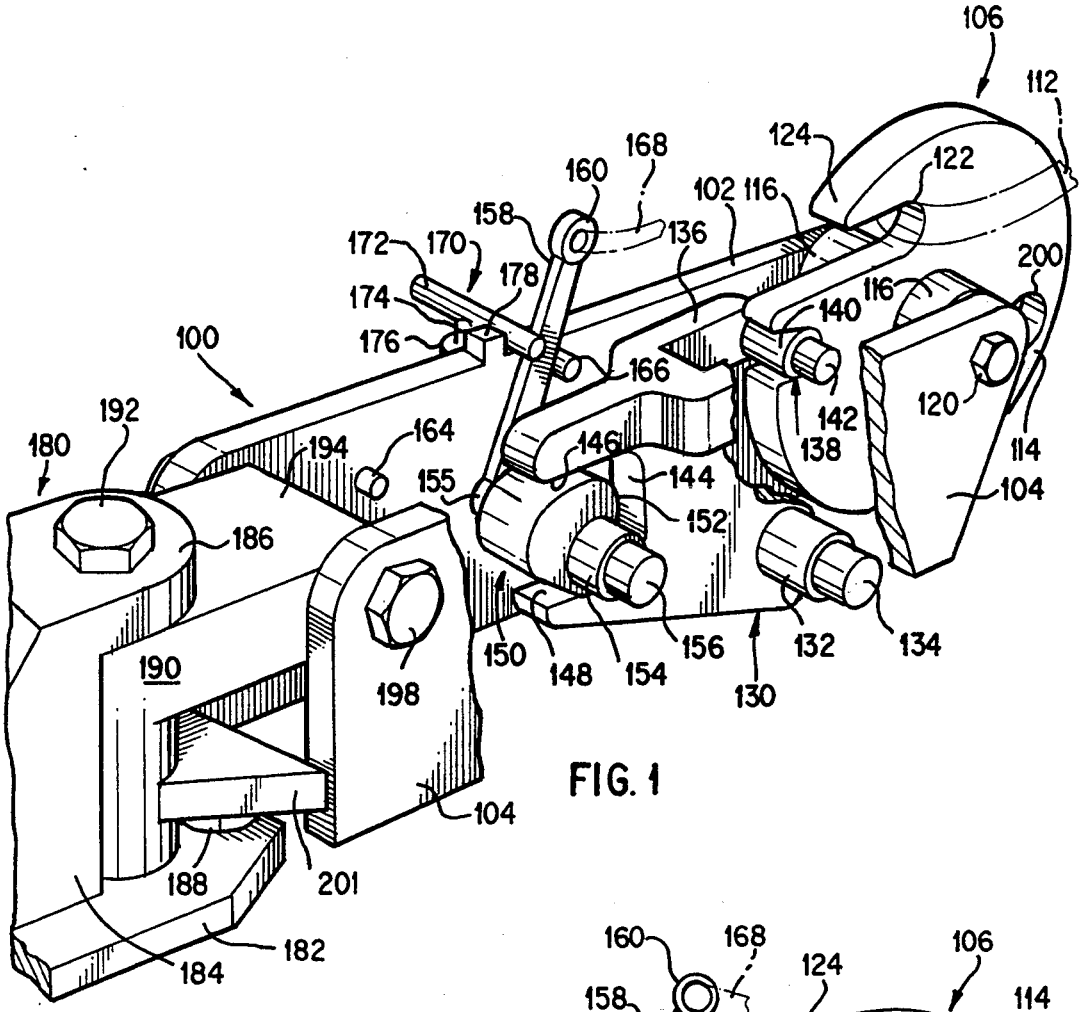

The rotary release hook apparatus 100 of this invention is comprised of a frame assembly consisting of a pair of spaced-apart and parallel side plates 102 and 104 which support the three basic primary functional components of this apparatus first a disc-like rotary hook 106 which is supported for rotation between the outer ends of the two side plates 102 and 104; secondly, a pivoted pawl assembly 130 located immediately behind the rotary hook 106 to secure the rotary hook, when appropriate, from rotation; and thirdly, a cam assembly 150 for interacting with the pawl assembly 130 for the purpose of either causing the engagement of the pawl assembly 130 with the rotary hook 106 to lock it for rotation, or for releasing it for rotational purposes. Finally, in conjunction with these three basic primary components, an auxiliary mechanism will be described later for latching the cam assembly 130. Also, near the end of this description, there will be described a special sturdy mounting bracket onto which the apparatus 100 of this invention is pivotally anchored.

Figure 4:
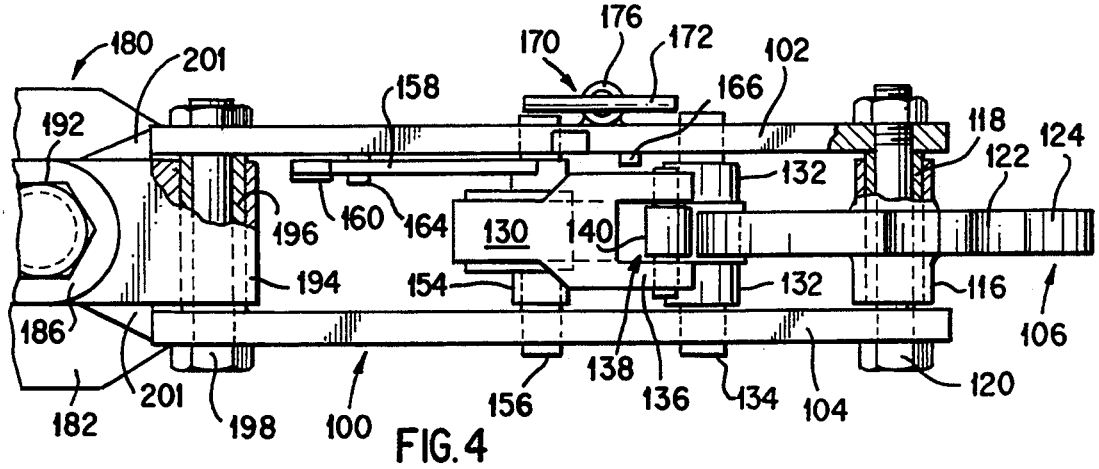
FIG. 4 is a fragmentary top plan view of the rotary release hook illustrating the frame, the cross-head, the pawl and the rotary hook; and, FIG. 5 is a fragmentary side elevational view illustrating the cross-head and part of the frame.
Figure 5:
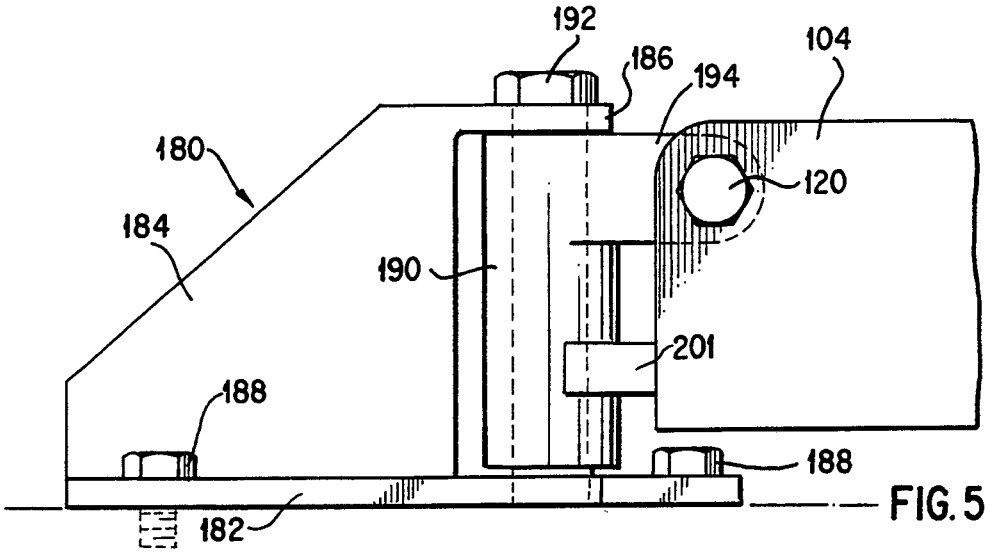

Defining the rotary hook 106 in greater detail, it consists of a disc-like central portion 114 with a pair of hubs 116 on opposite sides thereof and having a central bore or bearing surface into which is installed a sleeve 118, FIG. 4. The sleeve 118 is slightly longer than the bore in the rotary hook 106 so that when the sleeve 118 is firmly clamped between the side plates 102 and 104 by the bolt 120, the rotary hook 106 can still be free to rotate upon the sleeve 118. The clamping action of the bolt 120 also makes rigid the outer or forward ends of the side plates 102 and 104 with respect to each other. The rotary hook 106 is provided with a deep slot-like recess 122 which cooperates with its adjacent hook-like portion 124 to hold a mooring cable 112 or the like, such as a chain or rope for securing a seagoing vessel at a wharf. Additionally, a small dent-like recess 126 is located on the outer diameter of the central disc 114 for engaging with a apart of the previously mentioned pawl assembly 130.

Defining the pawl assembly 130 in greater detail, it is embodied in the unique shape shown in the various figures. It too is provided with a pair of hubs 132 at opposite sides thereof. The hub portions of the pawl assembly 130 are bored out to receive a cross shaft 134 that is long enough to span the total width of this apparatus including the side plates 102 and 104. The cross shaft 134 is fixedly supported at its end portions in aligned holes in the two side plates 102 and 104, thus permitting the pawl assembly 130 to pivot freely on the central portion of the cross shaft 134.

As shown in the drawing, the forward end of the pawl 130 is provided with a pair of forwardly projecting spaced-apart lugs 136 between which is mounted a roller assembly 138. The roller assembly 138 is designed to nest and engage with the smaller recess 126 in the rotary hook 106 for locking the rotary hook 106 firmly into position. The roller assembly 138 consists of a tubular roller 140 which is supported by a fixed cross shaft 142 which spans across and between the projecting lugs 136 and is secured to the lugs 136. At its opposite, or rear, side, the pawl assembly 130 has a wide rectangular jaw-like recess 144 having two opposed and parallel flat surfaces 146 and 148 which act as a pair of cam followers to slidably interact and engage with the third and final basic primary functional component of this invention; a cam assembly.

The cam assembly 150 consists of a centrally disposed cam portion 152 having a pair of hubs 154 and 155 mounted at opposite sides thereof. The hubs 154 and 155 are bored out to receive a cross shaft 156 that is long enough to span the total width of this apparatus including side plates 102 and 104. The cross shaft 156 is fixedly supported at its end portions in aligned holes in the two side plates 102 and 104 thereby permitting the cam assembly 150 to pivot freely on the central portion of the cross shaft 156. A control handle 158 is affixed to the hub 155 to actuate the cam assembly 150 between the two positions shown in FIGS. 2 and 3. It is important to be able to lock the handle 158 into the position shown in FIG. 1. Therefore, a special T-bar latching mechanism 170 is mounted on the side plate 102. The mechanism consists, in part, of a horizontally disposed bar 172 attached to vertically disposed shaft 174, see FIG. 1. The shaft 174 is mounted within a fixed tubular support 176 which allows rotation of the T-bar portion therein, Furthermore, the vertical shaft 174 (and indeed the entire movable T-bar portion) is allowed a small amount of vertical travel to at least clear the top of an upwardly projecting boss 178 located on the upper edge of the side plate 102, whenever the handle 172 of the T-bar 170 is being rotated to a parallel position such as shown in FIGS. 3 and 4.

Figure 2:
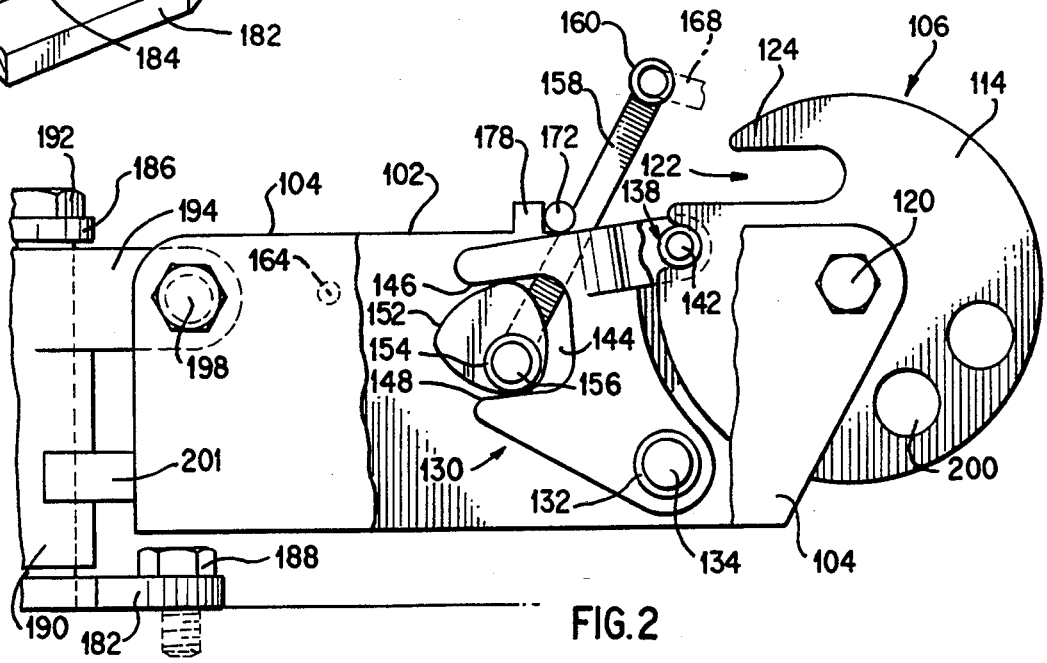

In FIGS. 1 and 2, the T-bar assembly 170 is shown with the control handle 158 securely captured behind the transversely disposed horizontal bar 172 and the adjacent boss 178. A notch 162 in the control handle 158 further ensures its capture. Reference is made to FIG. 3 which clearly shows the notch's position on the handle 158. In the latched position, the handle 158 is also rearwardly abutted against a stop pin 166 mounted on the inner wall of the side plate 102. The pin 166 restricts the handle's forward travel. With the handle 158 fully restrained in the position shown in FIGS. 1 and 2, the rotary hook 106 cannot be rotated even when subjected to heavy tension from a mooring cable 112.

On the upper and the outer end of the control handle 158 there is a knob 160 having a passageway 161. In the passageway 161 there is positioned a cord 168. With the cam 150 in the licked position illustrated in FIG. 1 the cord 168 may be securely positioned, even though the latching assembly 170 is moved to a position illustrated in FIGS. 3 and 4, so as to prevent rotation of the control handle 158. This prevents rotation of the cam 150 and prevents rotation of the hook 106.

Figure 3:
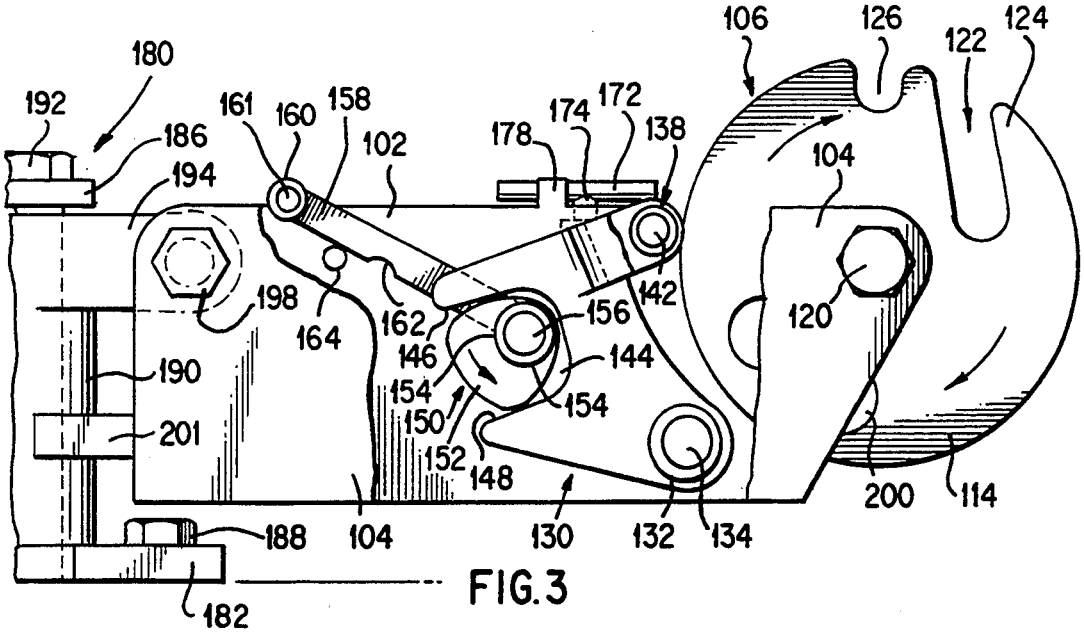
FIG. 3 is a fragmentary view, with part of the side of the frame broken away, and illustrates the rotor having rotated in a counter clockwise direction to rotate the pawl in a counter clockwise direction and away from the rotary hook to allow the rotary hook to rotate in a clockwise direction to release a cable.

When the time arrives for the release of the mooring cable 112, the latching assembly 170 must be manually released by rotating the horizontal bar 172 into the position shown in FIGS. 3 and 4. The cam portion is bearing against the upper flat surface 146 of the pawl assembly 130. Remember, the control handle 158 cannot rotate because the cord 168 is secured and cannot move. The cord 168 can be released to allow counter-clockwise movement of the handle 158. The cord can be pulled to rotate the handle 168 in a counter-clockwise direction to rotate the cam 150 in a counter-clockwise direction so as to have the cam portion 152 bear against the surface 148 to force the pawl assembly to rotate in a counter-clockwise direction . The pawl assembly 130 will at the same time, move away from the rotary hook 106 and permit the rotation of the rotary hook 106 in a clockwise motion, If the mooring cable happens to be under high tension the rotary hook 106 may spin rapidly at least for a short time until its kinetic energy is dissipated. The rotary hook may rotate for approximately 7 to 12 seconds.

However, the pawl 130 is now safely and positively held in retracted position by the action of the cam 150, so it cannot bounce back against the rotary hook 106 and threaten to cause damage to itself or the rotary hook 106. The cam portion 152 is bearing against surface 148 to prevent the rotation of the pawl assembly 130 in a clockwise direction. A release hook apparatus 106 can be used around flammable vapors such as hydrocarbon vapors from petroleum and other organic vapors. If the roller 140 were to suddenly and forcefully strike the hook 106 there could be a spark with a possible resulting fire or explosion. With the cam portion 152 bearing against the surface 148 the pawl assembly 130 is locked in position and cannot rotate in a clockwise direction to strike the hook 106 and to cause a spark.

The counter-clockwise rotation of the handle 158 is stopped by the stop 164 on the inside surface of the side plate 104. The handle 158 strikes the stop 164 and stops rotating.

Since the rotary hook 106 may be sometimes subjected to high speed rotation, it is necessary to have it properly balanced to reduce vibration. This may be accomplished by having holes 200 located at opposite sides of the rotor 106 from the recesses therein, as shown in the various figures.

As illustrated in the various figures, the operational apparatus 100 described herein is usually anchored to a wharf, a barge, an oil well drilling platform, as ship, and the like. This anchoring may be provided by a stationary mounting bracket 180 consisting of a base plate 182 having an upright standard 184 with a projecting ear 186 thereon. This stationary bracket 180 is shown anchored (as to a wharf) by bolts such as at 188. Interposed between the ear 186 and the baseplate 182 is a coupling member 190 pivotally mounted to the stationary bracket 180 by a vertically installed pivot bolt 192. The coupling member 190 has a forwardly projecting lug 194 which is bored out and sized to accommodate a tubular sleeve 196 which is inserted to rotate therewithin, see FIG. 4. The length of the sleeve 196 is equal to the length of the sleeve 118 which performs a similar function at the opposite or front end of the apparatus 100. The sleeve 196 is similarly clamped between the two side plates 102 and 104 which have both been suitably provided with axially aligned bolt holes through which a bolt 198 is inserted and clamped firmly, to make the rear end of the apparatus 100 very rigid also.

Since all the figures illustrated herein show the apparatus 100 being supported horizontally in a cantilever-like position upon the mounting bracket assembly 180 it is obvious from this arrangement that the apparatus 100 can be swung upwardly at a limited angle, if necessary, by pivoting around the axis of the horizontal bolt 198. When the apparatus 100 is again lowered, it is restricted from dropping below the horizontal position by the stops 201 mounted upon the coupling member 190. The apparatus 100 is also free to swing horizontally approximately 90 degrees in either direction around the axis of the vertical pivotal bolt 192.

Having thus fully described the basic features of this apparatus, it will be obvious to others skilled in the mechanical arts of this type that certain modifications may be made in the exact details without departing from the spirit of the invention.

RESUME

With respect to FIGS. 1–5 it is seen that there is a single action rotary hook apparatus 100 comprising a rotary hook 106.

In the rotary hook 106 there is a recess 122 for receiving a cable or a chain or a rope.

The rotary hook 106 has a curved notch 126.

There is a rotatable pawl assembly 130 having a roller assembly 138 for co-fitting with the curved notch 126.

There is a cam assembly 150 having two flat or straight surfaces connected by a curved surface. The flat or straight surfaces are at approximately 90 degrees.

There is a handle 158 for rotating the cam assembly 150.

In FIG. 2 it is seen that the roller assembly 138 of the pawl assembly 130 is positioned in the curved notch 126 of the rotary hook 106 so as to lock the rotary hook 106 in a set position. With the cable or rope or chain in the recess 122 of the hook 106 the cable or chain or rope is definitely positioned. In FIG. 2 it is seen that the curved surface of the cam assembly 150 is bearing against the upper surface 146 of the pawl assembly 130. This locks the rotary hook 106 in position so that the hook cannot rotate and the cable, or chain or rope is definitely positioned in the recess 122.

To allow the hook 106 to rotate and the cable 112 or chain 112 or rope 112 to escape from the recess 122 an operator can rotate the cam assembly 150 so that the curved surface is bearing against the lower surface 148 of the pawl assembly 130. The pawl assembly 130 can rotate in a counter clockwise direction. The cable or rope or chain can pull on the rotary hook 106 so as to rotate the rotary hook 106 to the position shown in FIG. 3 so as to allow the rope 112 or chain 112 to escape from the hook 106.

There is a locking mechanism for restricting the movement of the handle 158. The locking mechanism comprises a "T" 170 having a cross 172; an abutment 178 on the upper surface or the side 102; and two spaced apart stops 166 and 164.

There is a mounting bracket 180 on which the apparatus 100 is mounted. The apparatus 100 can rotate both vertically and horizontally with respect to the mounting bracket 180.

What I claim is:

1. A single action rotary release hook apparatus comprising:

a. a rotatable release hook of a generally circular configuration and having a main body;

b. a recess in said hook for receiving a cable;

c. said hook having a first part of a first locking means;

d. a rotatable pawl;

e. said pawl having a second part of said first locking means;

f. said first part and said second part of said first locking means are juxtapositioned to prevent the rotation of said hook;

g. said pawl having a first part of a second locking means;

h. with said pawl in operative contact with said hook and a rotatable member being in a first position and having a second part of said second locking means in contact with said first part of said second locking means for preventing rotation of said pawl and with said first part of said first locking means and with said second part of said first locking means operatively in contact with each other, said rotatable member prevents rotation of said hook, and with said rotatable member in a second position with said pawl being away from said hook and with said first part of said first locking means and with said second part of said first locking means not in operative contact with each other said rotatable member, having a second part of said second locking means in contact with said first part of said second locking means, prevents rotation of said pawl toward said hook;

i. release lever means for rotating said rotatable member;

j. said rotatable member being capable of being rotated to allow said pawl to rotate away from said release hook to inactivate said first locking means to allow said release hook to rotate;

k. said rotatable member operatively connecting with said pawl to restrict movement of said pawl toward said release hook;

l. said release hook having a notch being said first part of said first locking means;

m. said pawl having a first finger apparatus being said second part of said first locking means;

n. said pawl having a second finger and a third finger defining a second notch in the pawl and being a first part of said second locking means;

o. said rotatable member having a bearing surface, being said second part of said second locking means, against which said second finger of said pawl can bear;

p. said second notch in said pawl allows said rotatable member to rotate and to bear against said third finger to allow said pawl to move said first finger away from said recess in said release hook to allow said release hook to rotate;

q. said apparatus having a moveable arm;

r. said moveable arm operatively connecting with said rotatable member;

s. with said pawl in a position away from said release hook so as to allow said release hook to rotate, said rotatable member bears against said third finger to position and maintain said pawl away from said release hook to prevent said pawl contacting said release hook; and, t. stop means operatively connecting with said release lever means to restrict movement of said release lever means.

2. A single action rotary release hook apparatus comprising:

a. a rotatable release hook of a generally circular configuration and having a main body;

b. a recess in said hook for receiving a cable;

c. said hook having a first part of a first locking means;

d. rotatable pawl;

e. said pawl having a second part of said first locking means;

f. said first part and said second part of said first locking means are juxtapositioned to prevent the rotation of said hook;

g. said pawl having a first part of a second locking means;

h. with said pawl in operative contact with said hook and a rotatable member being in a first position and having a second part of said second locking means in contact with said first part of said second locking means for preventing rotation of said pawl and with said first part of said first locking means and with said second part of said first locking means operatively in contact with each other, said rotatable member prevents rotation of said hook, and with said rotatable member in a second position with said pawl being away from said hook and with said first part of said first locking means and with said second part of said first locking means not in operative contact with each other said rotatable member, having a second part of said second locking means in contact with said first part of said second locking means, prevents rotation of said pawl toward said hook;

i. a release lever means for rotating said rotatable member;

j. said rotatable member being capable of being rotated to allow said pawl to rotate away from said release hook to inactivate said first locking means to allow said release hook to rotate;

k. said rotatable member operatively connecting with said pawl to restrict movement of said pawl toward said release hook;

l. said release hook having a curved recess being said first part of said first locking means;

m. said pawl having an outwardly projecting first finger apparatus for mating with said curved recess and being said second part of said first locking means;

n. said pawl having a recess for a rotor and said recess being a first part of said second locking means and having spaced apart second finger having a first bearing surface and a third finger having a second bearing surface; and, o. said rotatable member being said rotor and being said second part of said second locking means and having a third bearing surface for bearing against said first bearing surface to prevent rotation of said pawl away from said release hook to prevent rotation of said release hook to prevent release of said cable and having said third bearing surface for bearing against said second bearing surface to prevent rotation of said pawl toward said release hook and to prevent contact between said pawl and said release hook.

3. A process of forming a rotatable release hook for releasing a cable, said process comprising:

a. forming said rotatable release hook of a generally circular configuration with a main body;

b. forming a recess in said hook for receiving a cable;

c. forming said hook to have a first part of a first locking means;

d. forming a rotatable pawl;

e. forming said pawl to have a second part of said first locking means;

f. juxtapositioning said first part and said second part of said first locking means to prevent the rotation of said pawl and thereby preventing rotation of said hook;

g. forming said pawl to have a first part of a second locking means;

h. positioning said pawl in operative contact with said hook and positioning a rotatable member in a first position and having a second part of said second locking means in contact with said first part of said second locking means for preventing rotation of said pawl and with said first part of said first locking means and with said second art of said first locking means operatively in contact with each other, said rotatable member prevents rotation of said hook, and with said rotatable member being in a second position with said pawl being away from said hook and with said first part of said first locking means and with said second part of said first locking means not in operative contact with each other said rotatable member, having a second part of said second locking means in contract with said first part of said second locking means, prevents rotation of said pawl toward said hook;

i. forming a release lever means for rotating said rotatable member;

j. forming said rotatable member to be capable of being rotated to allow said pawl to rotate away from said release hook to inactivate said first locking means to allow said release hook to rotate;

k. forming said release hook with a notch to be said first part of said first locking means;

l. forming said pawl with a first finger apparatus to be said second part of said first locking means;

m. forming said pawl with a second finger and a third finger defining a notch in said pawl to be said first part of said second locking means;

n. forming said rotatable member with a bearing surface, being said second part of said second locking means;

o. forming said notch in said pawl to allow said rotatable member to rotate and to bear against said third finger to allow said pawl to move said first finger away from said notch in said release hook to allow said release hook to rotate;

p. forming said rotatable release hook with a movable arm;

q. operatively connecting said movable arm with said pawl;

r. positioning said pawl away from said release hook to allow said release hook to rotate wherein said link positions and maintains said pawl away from said release hook to prevent said pawl from contacting said release hook; and, s. forming a stop means for operatively connecting with said release lever means to restrict movement of said release lever means.

4. A process for forming a rotatable release hook for releasing a cable, said process comprising:

a. forming said rotatable release hook of a generally circular configuration with a main body;

b. forming a recess in said hook for receiving a cable;

c. forming said hook to have a first part of a first locking means;

d. forming a rotatable pawl;

e. forming said pawl to have a second part of said first locking means;

f. juxtapositioning said first part and said second part of said first locking means to prevent the rotation of said pawl and thereby preventing rotation of said hook;

g. forming said pawl to have a first part of a second locking means;

h. positioning said pawl in operative contact with said hook and positioning a rotatable member in a first position and having a second part of said second locking means in contact with said first part of said second locking means for preventing rotation of said pawl and with said first part of said first locking means and with said second part of said first locking means operatively in contact with each other, said rotatable member prevents rotation of said hook, and with said rotatable member being in a second position with said pawl being away from said hook and with said first part of said first locking means and with said second part of said first locking means not in operative contact with each other said rotatable member, having a second part of said second locking means in contact with said first part of said second locking means, prevents rotation of said pawl toward said hook;

i. forming a release lever means for rotating said rotatable member;

j. forming said rotatable member to be capable of being rotated to allow said pawl to rotate away from said release hook to inactivate said first locking means to allow said release hook to rotate;

k. forming said release hook with a curved notch and being said first part of said first locking means;

l. forming said pawl with an outwardly projecting first finger apparatus mating with said curved notch, being said second part of said first locking means;

m. forming said pawl with a recess for a rotor and said recess being a first part of said second locking means and having spaced apart a second finger having a first bearing surface and a third finger having a second bearing surface; and, n. defining said rotatable member as said rotor and being said second part of said second locking means and forming said rotor with a third bearing surface for bearing against said first bearing surface to prevent rotation of said pawl away from said release hook to prevent rotation of said release hook and being capable of positioning said third bearing surface against said second bearing surface to prevent movement of said pawl toward said release hook and to prevent contact between said pawl and said release hook.

* * * * *